US007946584B2

(12) United States Patent
Meier

(10) Patent No.: US 7,946,584 B2
(45) Date of Patent: May 24, 2011

(54) CONVEYING ARRANGEMENT FOR THE TAKEOVER AND TRANSFER OF PRINTED PRODUCTS

(75) Inventor: Hanspeter Meier, Buron (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 12/404,619

(22) Filed: Mar. 16, 2009

(65) Prior Publication Data

US 2009/0230614 A1 Sep. 17, 2009

(30) Foreign Application Priority Data

Mar. 14, 2008 (EP) ..... 08405077

(51) Int. Cl.
*B65H 29/20* (2006.01)

(52) U.S. Cl. ..... 271/315; 271/187

(58) Field of Classification Search ..... 271/69, 271/70, 306, 314, 315, 187
See application file for complete search history.

(56) References Cited

U.S. PATENT DOCUMENTS

| | | | | |
|---|---|---|---|---|
| 6,196,538 | B1 * | 3/2001 | Stauber et al. | 271/69 |
| 6,612,563 | B1 * | 9/2003 | Noll, Jr. | 271/69 |
| 6,619,651 | B2 * | 9/2003 | Mader | 271/82 |
| 6,698,742 | B2 * | 3/2004 | Hansch | 270/52.22 |
| 2007/0216082 | A1 * | 9/2007 | Fenile et al. | 271/69 |

FOREIGN PATENT DOCUMENTS

| | | | |
|---|---|---|---|
| DE | 197 33 694 | A1 | 5/1998 |
| EP | 0 380 921 | A2 | 8/1990 |
| EP | 1 234 791 | A1 | 8/2002 |
| EP | 1 270 476 | A1 | 1/2003 |
| GB | 2 334 711 | | 1/1999 |

OTHER PUBLICATIONS

European Patent Office Search Report dated Oct. 13,.2008, directed to counterpart Application No. 08405077.2-1256 (10 pages).

* cited by examiner

*Primary Examiner* — David H Bollinger
(74) *Attorney, Agent, or Firm* — Venable LLP; Robert Kinberg; Leigh D. Thelen

(57) ABSTRACT

A conveying arrangement for printed products includes a feed conveyor to successively transport the printed products in a transporting direction to a takeover region, a transporting device having a transfer region to receive the printed products, and a circulating intermediate conveyor to transport the printed products from the takeover region to the transfer region of the transporting device. The circulating intermediate conveyor includes an endless track having a plurality of conveying elements to respectively grip the printed products and transport the gripped printed products from the takeover region to the transfer region where the printed products are transferred to the transporting device. The conveying elements have a swiveling axis that extends transverse to the transporting direction, wherein at least in an area between the takeover region and the transfer region, the conveying elements execute a controlled swiveling movement around the swiveling axis.

18 Claims, 7 Drawing Sheets

CONVEYING ARRANGEMENT FOR THE TAKEOVER AND TRANSFER OF PRINTED PRODUCTS

CROSS-REFERENCE TO RELATED APPLICATION

This application claims the priority of European Patent Document EP 08405077.2, filed on Mar. 14, 2008, the subject matter of which is incorporated herein by reference.

BACKGROUND OF THE INVENTION

The invention relates to a conveying arrangement for the takeover and transfer of printed products, the arrangement comprising a feed conveyor for successively transporting separate printed products to a takeover region and an intermediate conveyor for transporting the printed products from the takeover region to a transfer region, provided with a plurality of conveying elements along a continuously circulating track, which are designed to grip the individual printed products and transport these products from the takeover region to the transfer region where they can be transferred to a different transporting device. In the low performance range, the printed products can be transferred without the intermediate conveyor directly to the containers, for example to pouches or conduits. At higher speeds, however, the printed products can roll up or bounce back during the insertion, thus interrupting further processing. Thick products or stacks of products will impact with the containers owing to their high weight and the high speed.

Conveying arrangements of this type have long been known in the print processing industry. One such conveying arrangement is known, for example, from European Patent Document EP-A-1 234 791, in which the intermediate conveyor is provided with a plurality of circulating compartments that can open up when approaching a feed conveyor and can close for the further transport of the printed products. The feed conveyor is a transporter provided with suspended clamps that will open up in the aforementioned approach region. In the transfer region, the compartments of the intermediate conveyor are opened so that the printed products drop freely into the pouch-type receiving elements of an inserting machine.

European Patent Document EP-A-1 270 476 discloses a conveying arrangement where the printed products are removed from a stack with the aid of a traction mechanism and are supplied to an inserting machine that is provided with a plurality of pouches. The traction mechanism includes jointly operating pairs of rollers, between which the printed products are gripped and then released to the pouches in a transfer region.

European Patent Document EP-A-0 380 921 discloses an arrangement for taking over and transferring printed sheets or signatures, using an intermediate conveyor that is also provided with a plurality of clamps that are opened in a transfer region. The intermediate conveyor is embodied as a wheel and is provided along the periphery with a plurality of compartments, which are opened up in the transfer region, so that the products can drop freely into the pouches of an inserting machine.

The problem with the aforementioned conveying arrangements is that at extremely high speeds the printed products are not released carefully to the containers, which can cause the printed products to roll up and result in a delayed and unsatisfactory positioning of these printed products in the containers.

SUMMARY

It is an object of the present invention to create a conveying arrangement that permits a more careful release of the printed products or the previously collected stacks of products for further processing, even at a higher speed or output rate.

The above and other objects are accomplished according to one aspect of the invention wherein there is provided a conveying arrangement for printed products that includes a feed conveyor to successively transport the printed products in a transporting direction to a takeover region, a transporting device having a transfer region to receive the printed products, and a circulating intermediate conveyor to transport the printed products from the takeover region to the transfer region of the transporting device. The circulating intermediate conveyor includes an endless track having a plurality of conveying elements to respectively grip the printed products and transport the gripped printed products from the takeover region to the transfer region where the printed products are transferred to the transporting device. The conveying elements have a swiveling axis that extends transverse to the transporting direction, wherein at least in an area between the takeover region and the transfer region, the conveying elements execute a controlled swiveling movement around the swiveling axis.

In one embodiment, a generic conveying arrangement of this type may be controlled by the swiveling motion of the conveying elements for orienting the printed products in the transfer area, wherein these elements may be respectively swiveled around an axis extending transverse to the transporting direction. With the aid of the conveying arrangement and as a result of the swiveling motion of the individual elements, it is possible to track the movement of the containers in the transfer region with an optimum orientation of the printed products and to release the printed products with an optimum orientation and speed to the containers. The arrangement according to this embodiment makes it possible for the printed products follow the containers precisely during insertion. In principle, it can be said that the smaller the angle between the speed vectors for the containers and the supplied printed products and the smaller the difference in speed, the more gentle and careful the insertion of the printed products.

In another embodiment, the feed conveyor may be a belt conveyor to convey printed products that are uniformly spaced apart or which are arranged in an overlapping flow. In the transfer region, the printed products are respectively transferred to a conveying element that handles the further transport. In principle, a different conveying arrangement may also be used in place of the belt conveyor, for example one that is provided with clamps.

In an embodiment, the feed conveyor may extend substantially tangential to the intermediate conveyor, at least in the transfer region, wherein the transport in this region may occur vertically, from the top to the bottom. However, the products can in principle also be transported from the bottom to the top, in a horizontal direction, or at an angle.

In another embodiment, the individual conveying elements may each be provided with a transport member for transporting the printed products positioned on the respective conveying element. As a result, it is possible to compensate for a speed difference between the feed conveyor and the intermediate conveyor. The printed products can be slowed down or accelerated while positioned on the individual conveying elements. For example, if these printed products are supplied in an overlapping flow, for example only a slight overlap, to the intermediate conveyor, then the products in the overlapping flow can be pulled apart while positioned on the intermediate conveyor because they are individually transported on the separate conveying elements. Alternatively, it may also be possible to reduce the spacing between the individual printed products while these are positioned on the intermediate conveyor.

In an alternative embodiment, an especially secure and comparatively simple drive for the transport members may be obtained if the intermediate conveyor is provided with at least one drive cam, which respectively engages in the transport members in the transfer region, thereby moving the respective printed products on the conveying element.

In an embodiment, the intermediate conveyor may be provided with at least one second drive cam, which engages in the transport members in the transfer region, to remove and thus transfer the printed products from the respective conveying element. As a result, the printed products can be inserted into pouches even at high speeds. The transport members may be provided with at least one transport roller, on which the printed products are supported by resting against the respective conveying element. By correspondingly turning the transport rollers in one direction or the other, the printed products can be accelerated or slowed down.

A first drive cam is advantageously provided in the takeover region while a second drive cam is provided in the transfer region. As a result, it is possible to accelerate as well as slow down the printed products in both regions, thereby resulting in an especially high flexibility and an optimum transfer of the printed products.

In another embodiment, the conveying elements may be respectively provided with at least one clamp for clamping the individual printed products against a support surface of the respective conveying element. With these clamps, the printed products can be held in the respective takeover region against the respective conveying element and can thus be transported safely. According to another modified embodiment, the clamps may be arranged to swivel on the conveying element. By swiveling them in and out, the printed products can be clamped in or released. A spring may be arranged such that if the clamp is swiveled in, the printed product is clamped in. With the aid of a control cam for counteracting the spring force, the clamp can again be opened up and the printed products released.

According to a different embodiment, at least one clamp may be embodied such that the clamped-in printed products can be moved in a transporting direction or counter to the transporting direction, respectively on an outside surface of the conveying element. For this, the clamps are provided with rollers to permit the aforementioned movements. The individual printed products are thus clamped against the conveying element with at least one clamp, but may be moved in a conveying direction or counter to the conveying direction while positioned on the conveying element. As a result, it is possible to accelerate or slow down the printed products in the takeover region as well as in the transfer region, as mentioned above, while simultaneously providing a secure guidance.

According to one embodiment, the intermediate conveyor may be provided with a cam for swiveling the conveying elements and the conveying elements may be provided with a cam roller, which engages at least in some sections in the cam and thus permits a particularly secure swiveling of the conveying elements in the transfer region. The swiveling movement can be adjusted precisely and can also be changed by correspondingly adjusting the cam.

Another embodiment provides that the intermediate conveyor may be embodied as a wheel and that the conveying elements may be arranged along the periphery of the wheel. It is therefore advantageous if the endless track of the conveying elements is a circular track. However, a different track, for example an oval track, may also be used in principle.

In another embodiment, the conveying elements may include one outer support surface for the printed products, wherein these support surfaces respectively function as an outer shell surface of the wheel when the individual conveying element is in the basic position. It is advantageous if the support surfaces jointly form a circular surface in the takeover region, to which the printed products can be supplied, for example tangentially, and can thus be taken over. Following the takeover region, the conveying elements can be swiveled with a front edge toward the outside or toward the inside.

In an embodiment, the printed products may be transferred to a conveying arrangement provided with pouches, into which the printed products may be inserted and in particular may be tossed from the top. These pouches, for example, can be the pouches of an inserting machine and may be arranged in the form of a ring as shown in European Patent Document EP-A-1 234 791. However, other holding devices, for example clamps and the like, can also be provided in place of the pouches.

Additional advantageous features follow from the dependent claims, the description below, as well as the drawings.

BRIEF DESCRIPTION OF THE DRAWINGS

The present invention will be more readily understood from the following detailed description when read in conjunction with the accompanying drawings, in which.

DETAILED DESCRIPTION

Figure 1:
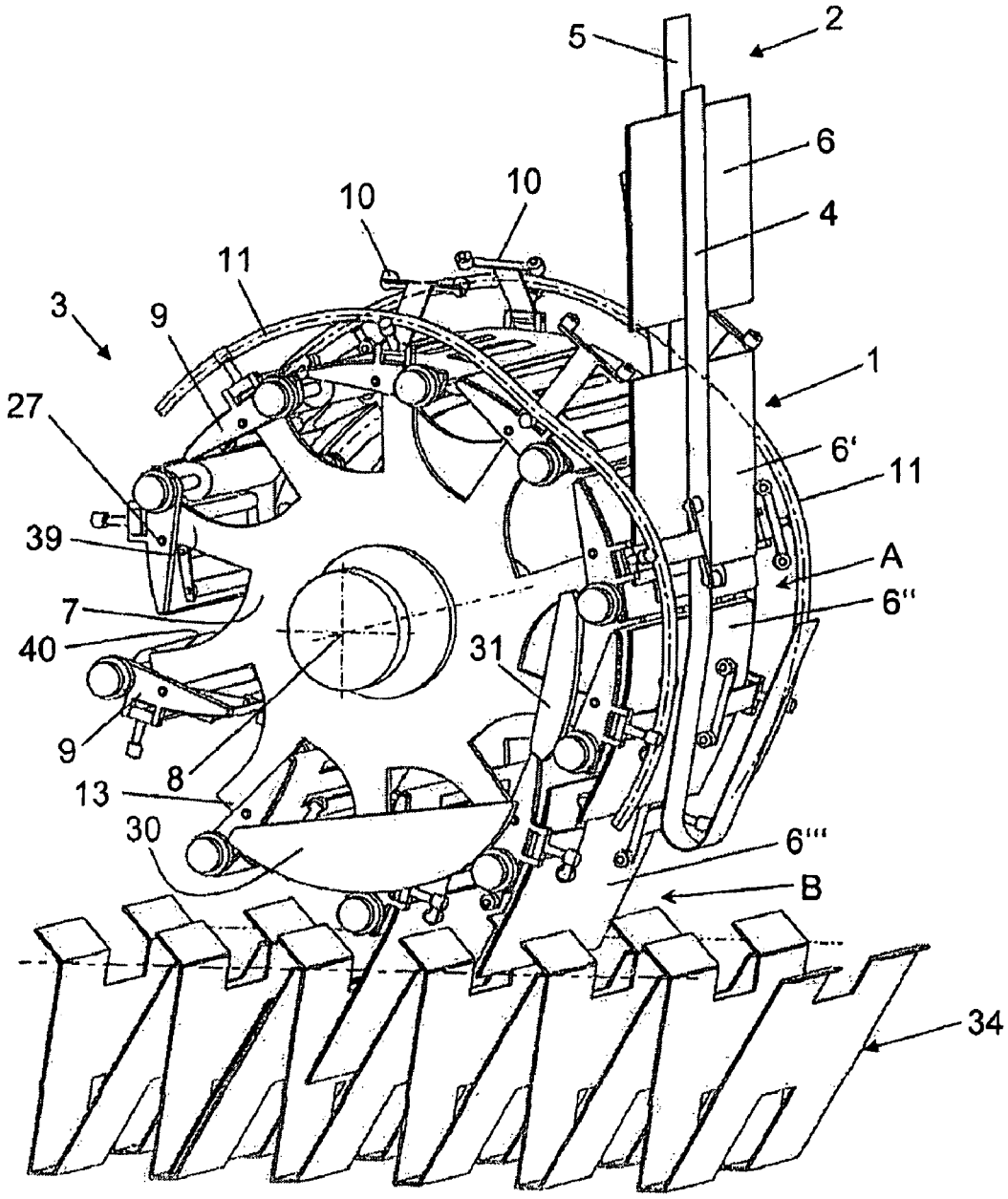
FIG. 1 is a schematic three-dimensional top perspective view of a conveying arrangement according to the invention.
Figure 2:
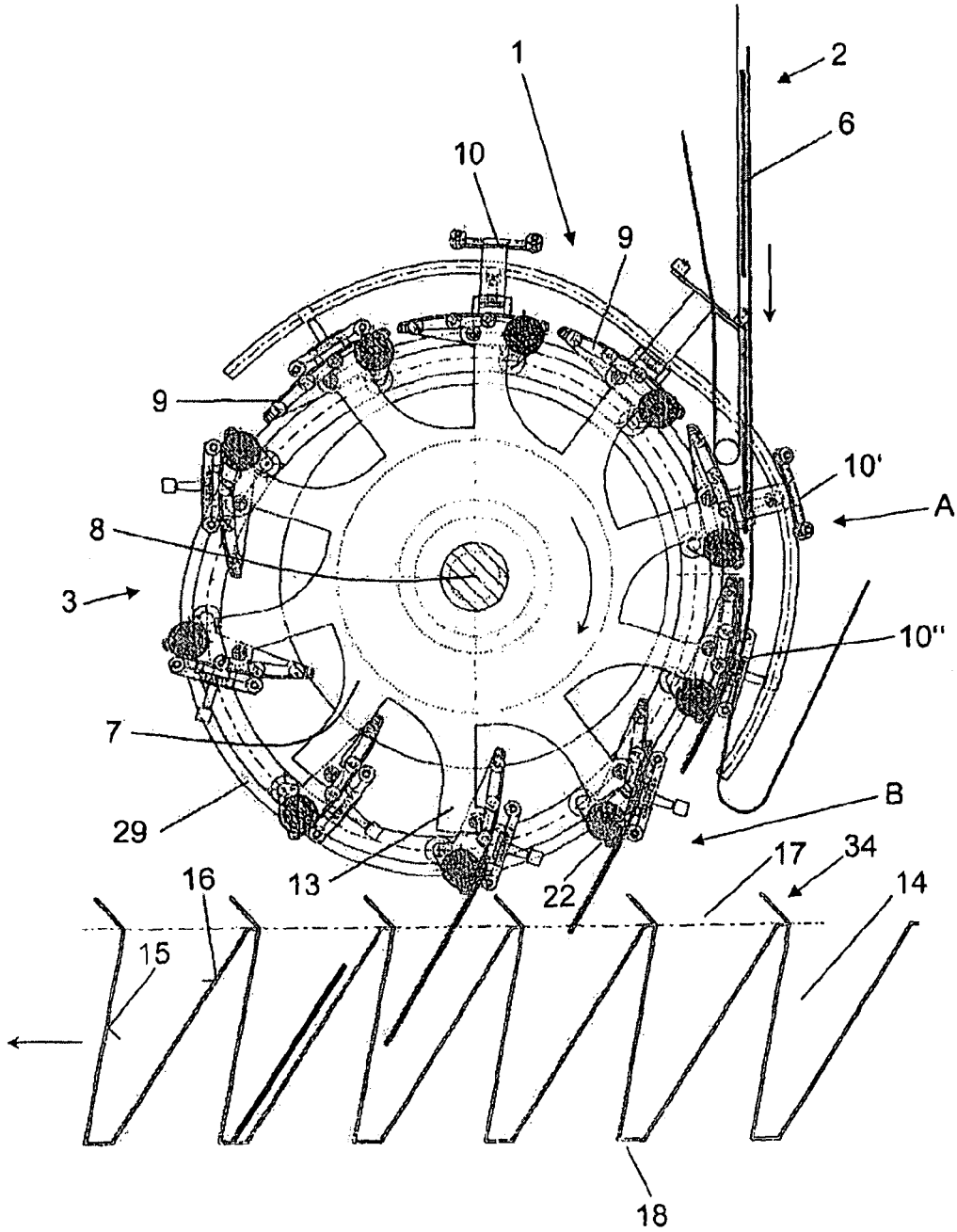
FIG. 2 is a different side view of the conveying arrangement according to FIG. 1.

An embodiment of the conveying arrangement 1, shown in FIGS. 1 and 2, includes a feed conveyor 2 for transferring printed products 6 in a takeover region A to an intermediate conveyor 3, which rotates around an axis 8. The intermediate conveyor 3 is driven with the aid of a drive (not shown) and rotates in clockwise direction, as shown in FIGS. 1 and 2. The printed products 6, which are transferred to the intermediate conveyor 3, are subsequently transferred from the intermediate conveyor 3 to a transporting device 34, which conveys the printed products from the left to the right, as shown in FIG. 2. In the transporting device 34, each printed product 6 is then deposited into a pouch 14 or a similar container, or it is held by a clamp. FIG. 2 describes an embodiment where the printed products 6 are taken over at approximately the three o'clock position and are released again to the transporting device 34 at approximately the six o'clock position. Other positions are also possible for the takeover as well as for the transfer of products. The printed products 6 are transported successively and uniformly spaced apart in the feed conveyor 2. However, the printed products 6 can in principle also be transported while arranged in an overlapping flow in the feed conveyor 2. The printed products 6 may be individual sheets, stacks of sheets, magazines, newspapers and the like. For the embodiment shown herein, the feed conveyor 2 is a belt conveyor, but could also be a different, suitable transporting device, such as a device with clamps or grippers. In the takeover region A, the printed products 6 may be transported in a direction that runs tangential to the periphery of the intermediate conveyor 3.

The feed conveyor 2 takes over the printed products 6 from a device (not shown) and conveys these products between two conveying belts 4 and 5, shown only in some sections of FIG. 1. The conveying belts 4 and 5 are endless belts that are fitted and driven around corresponding deflection rollers. FIGS. 1 and 2 show that the printed products 6 are transported in a substantially vertical direction, from top to bottom. In the takeover region A, the printed products 6 are transferred to the intermediate conveyor 3. FIG. 1 shows a printed product 6' in the process of entering the region of the intermediate conveyor 3 while a printed product 6" has already been transferred to the intermediate conveyor 3. A further printed product 6'" is released by the intermediate conveyor 3 and is inserted into a pouch 14.

Figure 3:
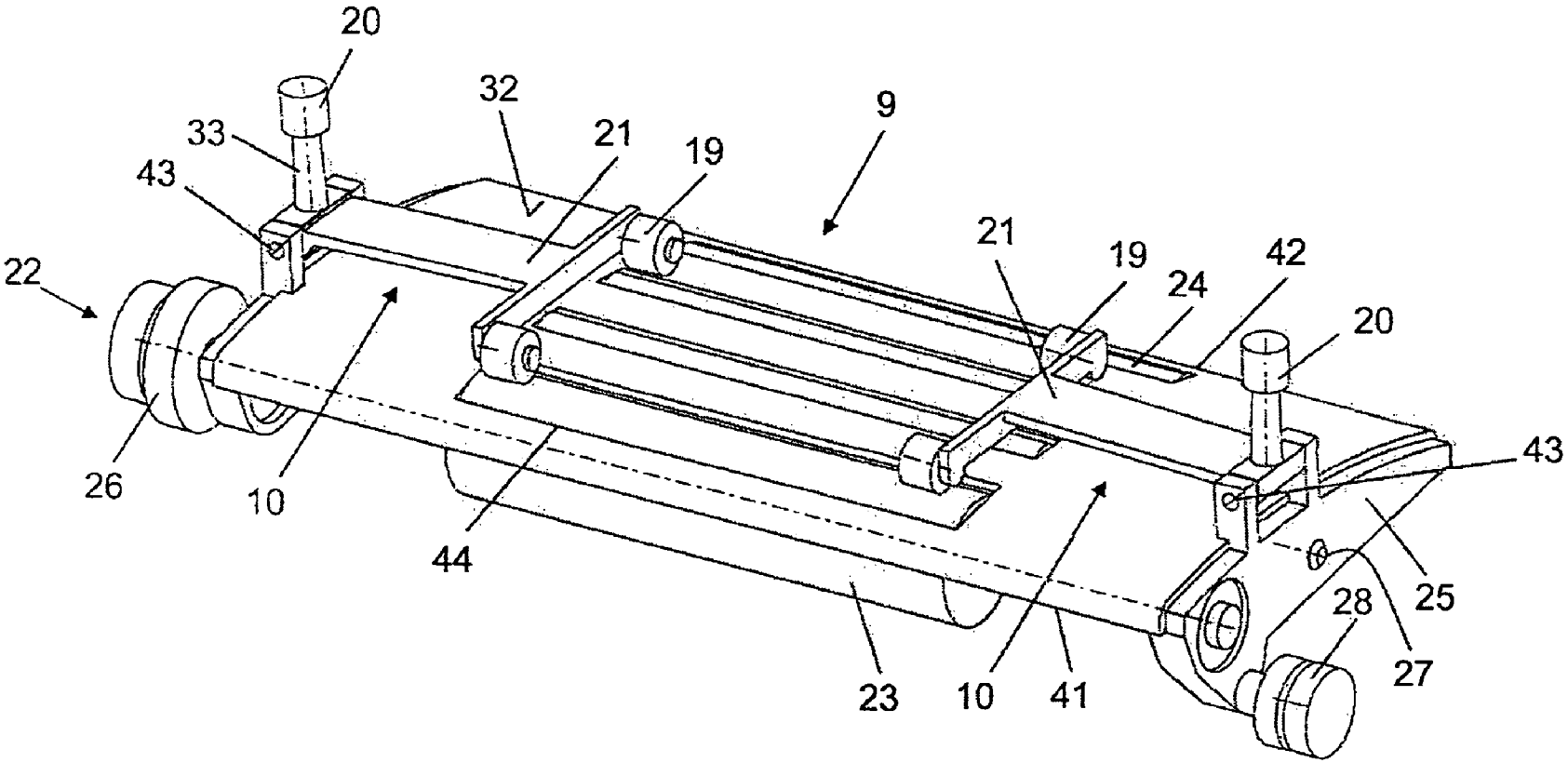
FIG. 3 is a schematic three-dimensional top perspective view of a conveying element according to the invention.

The intermediate conveyor 3 comprises a wheel 7 with two star-shaped plates 35 and 36 (FIG. 6), arranged at a distance to each other, wherein this wheel is positioned with the ends of the axis 8 inside a machine frame (not shown). The plates 35 and 36 are respectively provided with a plurality of bearing parts 39 (FIG. 1), extending essentially in radial outward direction, between which respectively one recess 40 is arranged. A separate conveying element 9 is positioned swiveling at each of the outer ends 13 of these bearing parts 39. The conveying elements 9 each have a front edge 41 and a back edge 42, as shown in FIG. 3, which extend parallel to each other and parallel to a swiveling axis 27. This swiveling axis 27 is essentially positioned between the two edges 41 and 42, as shown in FIG. 3. The conveying elements 9 are distributed along the periphery of the wheel 7, uniformly spaced apart, and can be swiveled similar to the slats of a shutter. Extending between the edges 41 and 42 is a surface area 32, which is either straight or is curved toward the outside, corresponding to the peripheral surface of the wheel 7, and which forms a support surface or a contact surface for respectively one printed product 6.

To ensure that each of the printed products 6 can be gripped and transported by the conveying elements 9, these conveying elements are respectively provided with two clamps 10 that may be swiveled around a swiveling axis 43, as shown in FIG. 3, and are connected to a base body 25 of a conveying element 9. A spring element (not shown) could be a torsion spring mounted on the axis 43 that acts upon the clamp 10 to move it into the closed position. The individual clamps 10 are provided with a lever 21, on which two spaced-apart rollers 19 are positioned at a distance to the axis 43. The clamps 10 furthermore are provided with respectively one cam roller 20, arranged on a lever 33, which cooperates with a clamp cam 11 that is shown in FIGS. 1 and 2. The clamp cam 11 counteracts the spring force exerted to close the clamp 10. With the aid of this control, the clamps 10 can respectively be swiveled between the clamping position shown in FIGS. 3 and 6 and an open position shown in FIGS. 1 and 2. Upstream of the takeover region A, the clamps 10 are in the opened position and transition to the closed position when they reach the transfer region B. In FIG. 2, the clamps 10 are in the opened position, at approximately the two o'clock position, while they are in the clamping or closed position at approximately the four o'clock position. In FIG. 2, the clamps 10' are in an in-between position. The clamps 10" are already in the clamped or closed position, in which the respective printed product 6" is held against the conveying element 9. The lever 21 may be produced from an elastic material to compensate for differences in the thickness of the printed products 6 or the product stack 45.

Figure 5:
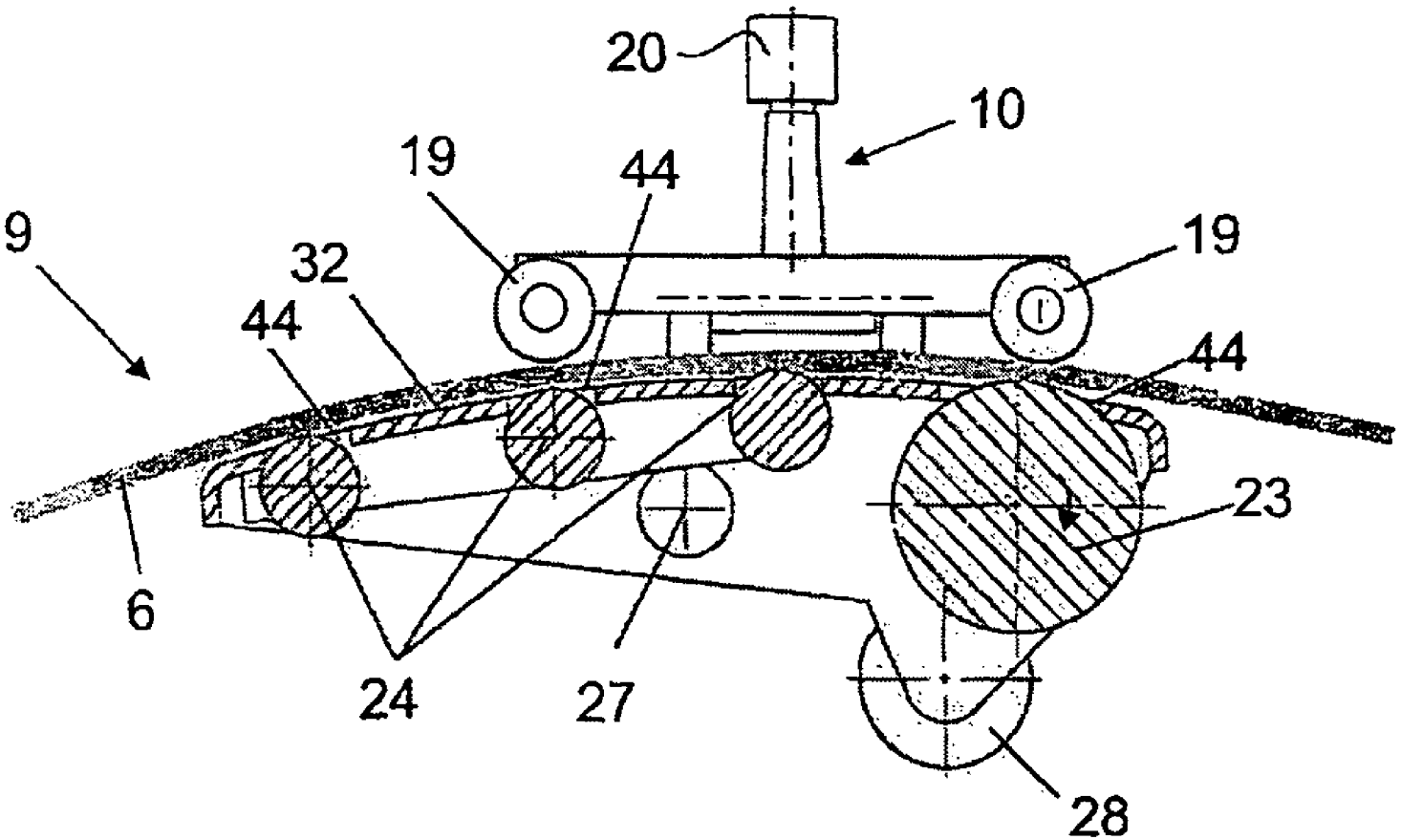
FIG. 5 is a section through the conveying element along the line V-V in FIG. 6.

Downstream of the takeover region A, the printed products 6 are respectively held in place on the conveying elements 9 so that they may be transported on these elements. FIGS. 3 and 5 an embodiment where the conveying elements 9 have a plurality of recesses 44, into which project a transport roller 23 or additional and parallel positioned rollers 24. When the clamps 10 are closed, the clamp rollers 19 respectively rest against an outer surface 37 of the transport roller 23 or a roller 24. In a peripheral direction of the wheel 7, the printed products 6 can thus be moved between the clamp rollers 19 and the transport roller 23 or the rollers 24. According to the embodiment described in FIG. 6, the transport roller 23 is positioned rotating on the two plates 35 and 36 and is equipped at one end with a drive component 26, which functions as a drive together with a cam 30, 31. The cam 30, 31 can have a one-piece embodiment or, as shown in FIG. 1, can be composed of multiple parts. These cams 30, 31 are installed locally fixed and are advantageously designed to be adjustable. If the wheel 7 rotates, the transport roller 23 is rotated around its longitudinal axis in the intended region by engaging in the cam 30 or 31. Together with the cams 30 and 31 and the clamps 10, the transport rollers 23 thus form a transport member 22 for transporting the printed products 6 on the conveying element 9 in the desired region, wherein the products may be transported first in the takeover region A and then in the transfer region B. The transport member 22 can also be realized with other suitable elements, such as a belt or the like, instead of the transport roller 23 and the clamp rollers 19. For example a belt may be fitted around the two rollers 19 of a gripping member 10.

Figure 6:
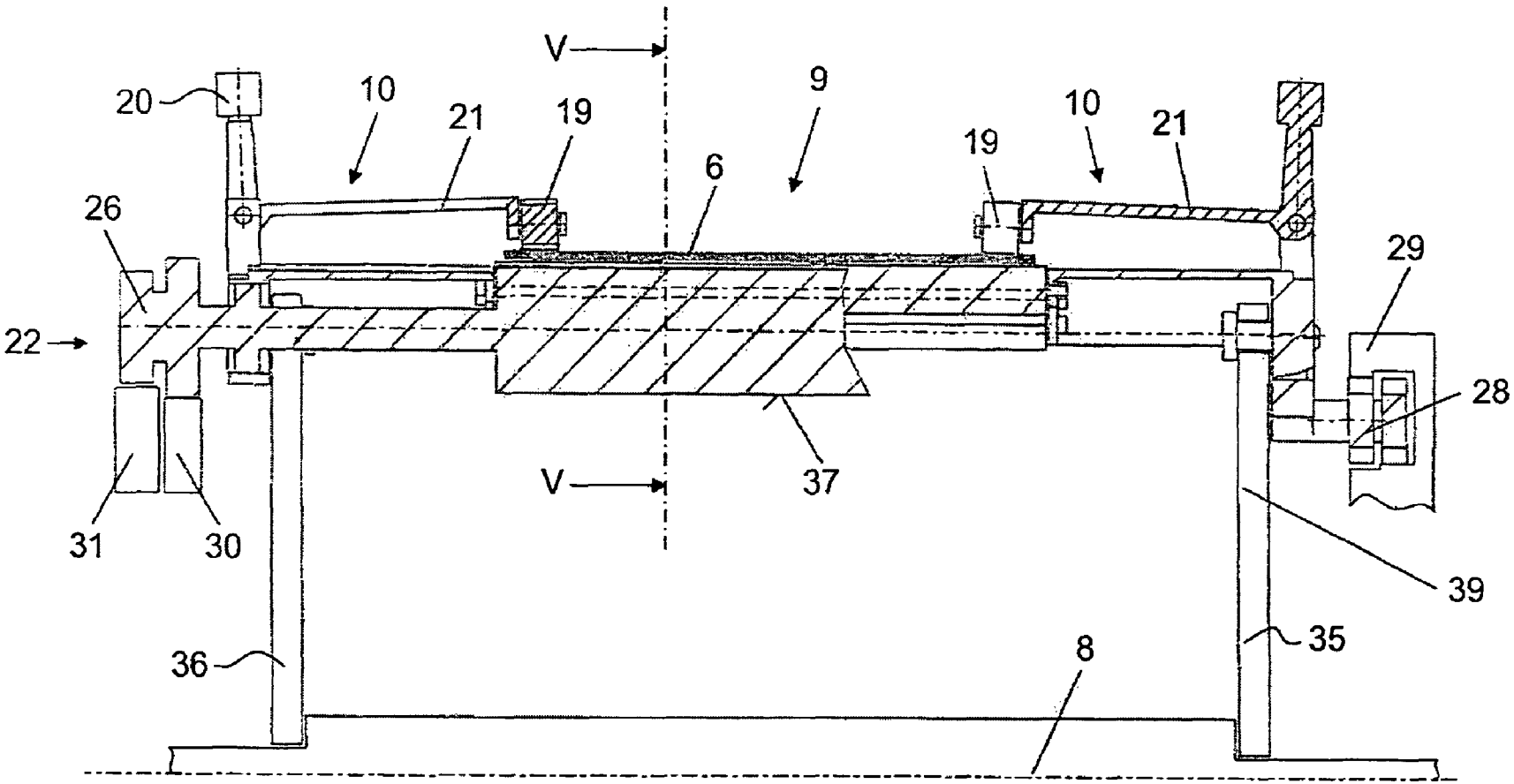
FIG. 6 is an alternative section view through the conveying element according to the invention.

FIG. 1 describes an embodiment where for the initial transport, the drive component 26 (shown in FIG. 3) engages in the cam 31. According to FIG. 1, the component first engages in the cam at approximately the two o'clock position, in which the front end of the printed product 6' impacts with a conveying element 9. The transport of the printed product 6' and 6" is above all designed to compensate for a speed difference between the feed conveyor 2 and the intermediate conveyor 3. In the process, the spacing between the printed products 6 can be reduced or also increased. In addition, the printed products 6 that are conveyed in an overlapping flow can be separated during this transport. The speed for conveying the printed products 6 on the conveying element can be influenced by changing the diameter of the drive component 26, which is operatively engaged in the cams 30, 31. A smaller diameter for the drive component 26 will result in a higher conveying speed on the conveying element 9. The drive component 26 can also have a plurality of different diameters, as shown in FIG. 6, to which respectively one of the cams 30, 31 is assigned. The transporting speed of the conveying element 9 may therefore be different in the takeover region A than in the transfer region B.

It is furthermore conceivable that the cams 30, 31 are embodied in the form of a ring, which could be driven to rotate around the axis 8, thus also making it possible to change the transporting speed of the conveying elements 9.

Once the drive component 26 engages in the cam 30, a printed product 6'" can be driven in the transfer region B and, if desired, can be accelerated, so that it is released by the respective conveying element 9 and inserted into a pouch 14. The engagement and the operating range of the cam 30 follows that of the cam 31 and is located in the lower portion of the wheel 7, as shown in FIGS. 1 and 2.

Figure 4:
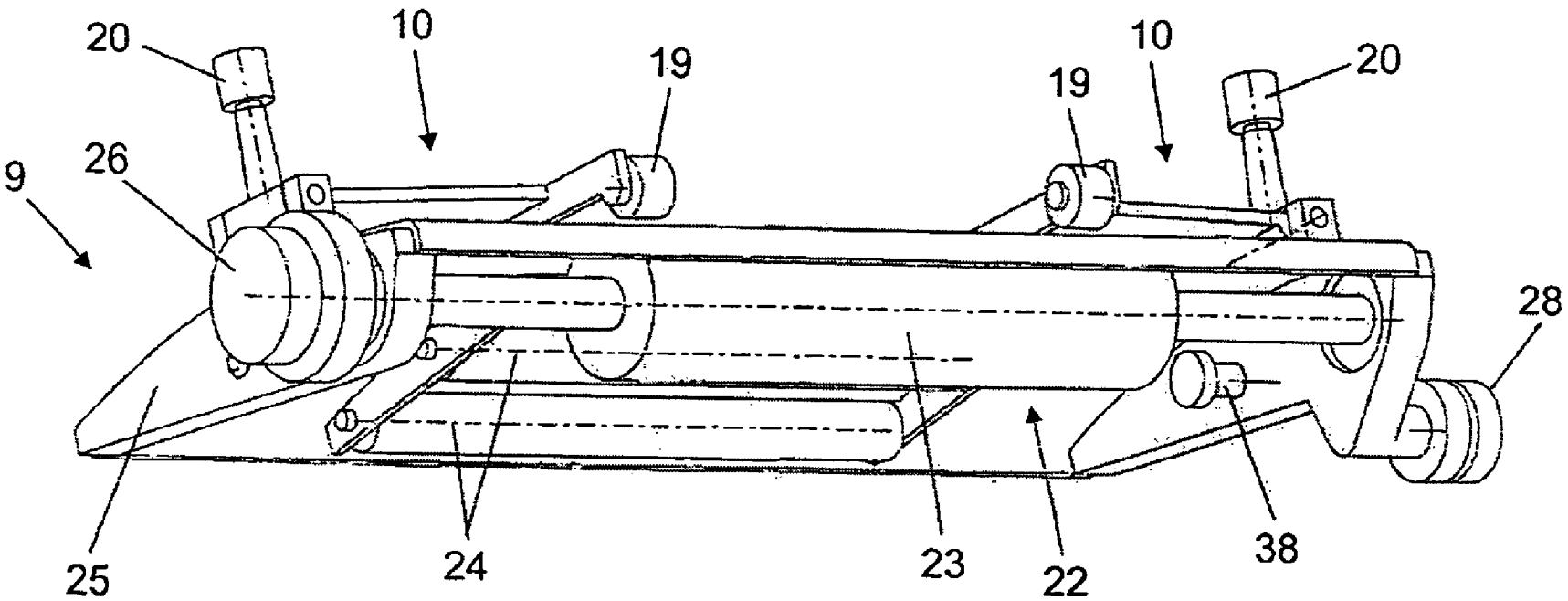
FIG. 4 is a bottom perspective view of the conveying element according to FIG. 3.

A different and essential function of the conveying elements 9 is that they can be swiveled around the axis 27. According to FIG. 4, the base body 25 is provided on the inside with a bearing journal 38 for positioning it such that it can swivel. At a distance thereto, rollers 28 are arranged on the base body 25, as shown in FIGS. 3 and 4, which operate jointly with a cam 29 as shown in FIG. 6. As a result of the engagement of the rollers 28 in the cam 29, the conveying elements 9 are swiveled in the transfer region B, such that the back edge 42 is moved into a recess 40 and the front edge 41 is essentially moved radially toward the outside. The individual printed products 6 are swiveled with the aid of this swiveling movement and are thus oriented correctly for the deposit in one of the pouches 14. In FIG. 1, the printed product 6" is in a basic position where it extends substantially parallel to the outer shell surface of the wheel 7. The printed product 6''' has already been swiveled and positioned to point downward at an angle. The speed components for printed product 6''' have furthermore been adapted to the speed of the transporting device 34, thereby permitting a careful and flowing transition of the printed product 6''' from the intermediate conveyor 3 to the transporting device 34. As a result of this precise positioning, comparably heavy printed products 6 or product stacks 45, as well as comparably light printed products 6, can be deposited carefully and at comparably high processing speeds into the pouches 14.

It is furthermore essential that the pouches 14 are also treated with care. Each of the pouches comprises an inside area 15 and a different inside area 16, as well as a bottom 18. The printed products 6 are dropped into the pouches through an upper opening 17. During the downward drop, the printed products 6 are for the most part directed toward the inside area 15 and the bottom 18. The inserted printed products 6 finally come to rest against the inside area 16, as shown in FIG. 2. The printed products 6 leave the conveying element 9 once the major portion of this conveying element has been submerged into the respective pouch 14, as shown in FIGS. 1 and 2.

Once the printed product 6 has finally been released to the transporting device 34, the conveying elements 9 along with the cam 29 are swiveled back to the starting position, which is approximately the 11 o'clock position as shown in FIG. 2.

It is also critical that the printed products 6 are held in place by the two clamps 10 during the transfer to the transporting device 34. The printed products 6 are thus held in place and guided while they are transported on the respective conveying element 9, until they are released completely. With the embodiment as shown, the printed products 6 are inserted into empty pouches 14, wherein these pouches 14 or other containers can already contain a printed product that is also opened, thus making it possible to insert the printed products 6 as inserts into different printed products. It is also important in that case to have a careful, flowing and clocked transfer, which ensures that the printed products 6 in the form of inserts are placed precisely. Such a careful and precise transfer is critical even if other types of containers are used or if clamps, for example, are used in place of the pouches 14.

Figure 7A:
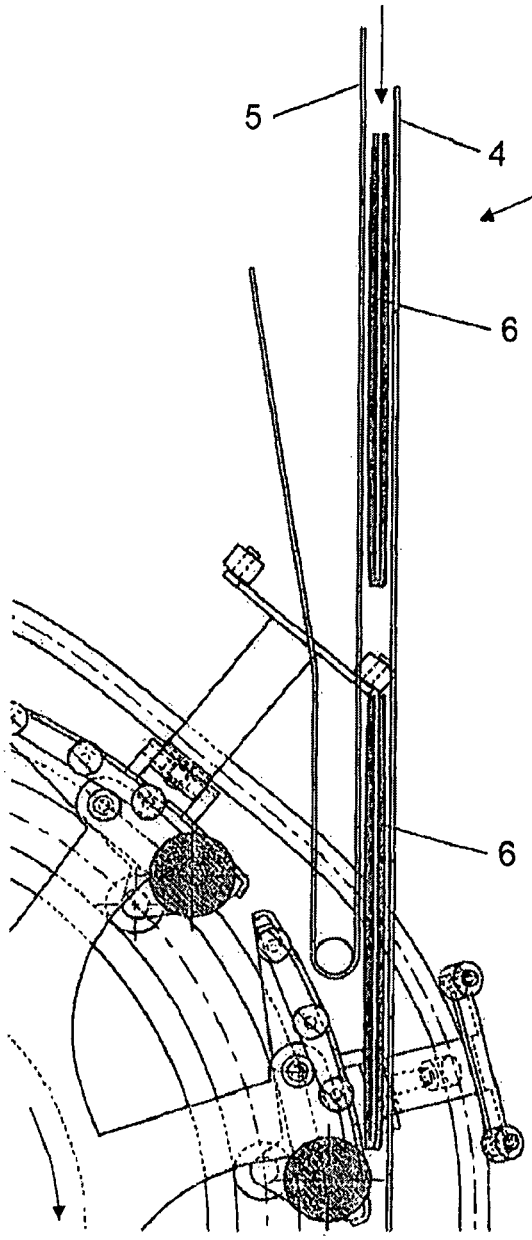
FIGS. 7*a* and 7*b* are enlarged views of the takeover region shown in FIG. 2 of the present invention.
Figure 7B:
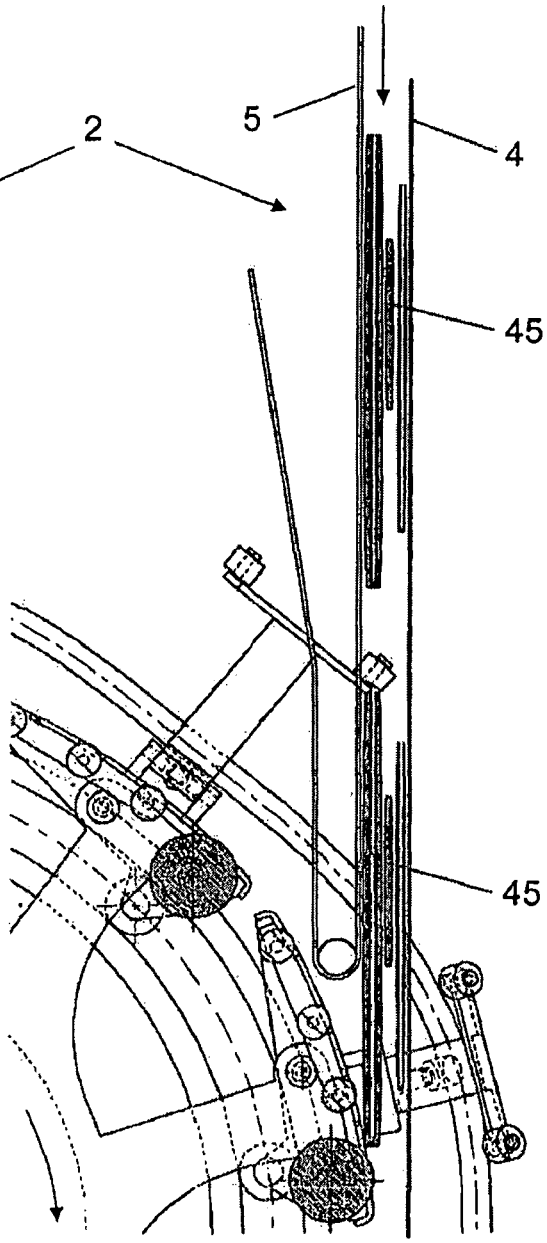

According to the embodiment described FIG. 7*a*, individual printed products 6 may be processed further with the conveying arrangement. Also possible is the processing of product stacks 45, which may be composed of a plurality of printed products or inserts such as CDs, cards, etc., as shown in FIG. 7*b*. In the process, the product stacks 45 are gathered inside a device (not shown) and is installed upstream of the conveying arrangement while clamped between the conveying belts 4, 5 of the feed conveyor 2 of the conveying arrangement.

It will be understood that the above description of the present invention is susceptible to various modifications, changes and adaptations, and the same are intended to be comprehended within the meaning and range of equivalents of the appended claims.

What is claimed is:

1. A conveying arrangement for printed products, comprising:

a feed conveyor to successively transport the printed products in a transporting direction to a takeover region;

a transporting device having a transfer region to receive the printed products; and a circulating intermediate conveyor to transport the printed products from the takeover region to the transfer region of the transporting device, the circulating intermediate conveyor including an endless track having a plurality of conveying elements to respectively grip the printed products and transport the gripped printed products from the takeover region to the transfer region where the printed products are transferred to the transporting device, the conveying elements having a swiveling axis that extends transverse to the transporting direction, wherein at least in an area between the takeover region and the transfer region, the conveying elements are mounted and arranged to swivel in a controlled movement around the swiveling axis, and wherein the feed conveyor supplies the printed products approximately tangential to the circulating intermediate conveyor, at least in the takeover region.

2. The conveying arrangement of claim 1, wherein the feed conveyor comprises a belt conveyor.

3. A conveying arrangement for printed products, comprising:

a feed conveyor to successively transport the printed products in a transporting direction to a takeover region, wherein the feed conveyor transports the printed products approximately in a vertical direction;

a transporting device having a transfer region to receive the printed products; and a circulating intermediate conveyor to transport the printed products from the takeover region to the transfer region of the transporting device, the circulating intermediate conveyor including an endless track having a plurality of conveying elements to respectively grip the printed products and transport the gripped printed products from the takeover region to the transfer region where the printed products are transferred to the transporting device, the conveying elements having a swiveling axis that extends transverse to the transporting direction, wherein at least in an area between the takeover region and the transfer region, the conveying elements are mounted and arranged to swivel in a controlled movement around the swiveling axis.

4. A conveying arrangement for printed products, comprising:

a feed conveyor to successively transport the printed products in a transporting direction to a takeover region;

a transporting device having a transfer region to receive the printed products; and a circulating intermediate conveyor to transport the printed products from the takeover region to the transfer region of the transporting device, the circulating intermediate conveyor including an endless track having a plurality of conveying elements to respectively grip the printed products and transport the gripped printed products from the takeover region to the transfer region where the printed products are transferred to the transporting device, the conveying elements having a swiveling axis that extends transverse to the transporting direction, wherein at least in an area between the takeover region and the transfer region, the conveying elements are mounted and arranged to swivel in a controlled movement around the swiveling axis, wherein the conveying elements include a transport member to transport the printed products on each of the conveying elements.

5. The conveying arrangement of claim 4, wherein the transport member is controllable to compensate for a difference in speed between the feed conveyor and the circulating intermediate conveyor.

6. The conveying arrangement of claim 4, wherein the circulating intermediate conveyor includes a frame and at least one drive cam mounted immovably on the frame, wherein each transport member engages with the drive cam in the area between the takeover region and the transfer region.

7. The conveying arrangement of claim 6, wherein the drive cam comprises a first cam section associated with the takeover region and a second cam section following the first cam section in the transporting direction and associated with the transfer region.

8. The conveying arrangement of claim 4, wherein the transport member includes a transport roller to transport the printed products.

9. A conveying arrangement for printed products, comprising:

a feed conveyor to successively transport the printed products in a transporting direction to a takeover region;

a transporting device having a transfer region to receive the printed products; and a circulating intermediate conveyor to transport the printed products from the takeover region to the transfer region of the transporting device, the circulating intermediate conveyor including an endless track having a plurality of conveying elements to respectively grip the printed products and transport the gripped printed products from the takeover region to the transfer region where the printed products are transferred to the transporting device, the conveying elements having a swiveling axis that extends transverse to the transporting direction, wherein at least in an area between the takeover region and the transfer region, the conveying elements are mounted and arranged to swivel in a controlled movement around the swiveling axis, wherein each of the conveying elements includes at least one clamp to hold the printed products.

10. The conveying arrangement of claim 9, wherein the at least one clamp is swiveled transverse to the transporting direction, between a clamped position and an opened position.

11. The conveying arrangement of claim 10, wherein the at least one clamp is arranged to hold the printed products in place on each of the conveying elements so that the printed products are movable in the transporting direction.

12. The conveying arrangement of claim 9, wherein the circulating intermediate conveyor further includes a locally fixed control cam that swivels the clamp counter to a spring force.

13. A conveying arrangement for printed products, comprising:

a feed conveyor to successively transport the printed products in a transporting direction to a takeover region;

a transporting device having a transfer region to receive the printed products; and a circulating intermediate conveyor to transport the printed products from the takeover region to the transfer region of the transporting device, the circulating intermediate conveyor including an endless track having a plurality of conveying elements to respectively grip the printed products and transport the gripped printed products from the takeover region to the transfer region where the printed products are transferred to the transporting device, the conveying elements having a swiveling axis that extends transverse to the transporting direction, wherein at least in an area between the takeover region and the transfer region, the conveying elements are mounted and arranged to swivel in a controlled movement around the swiveling axis, wherein the circulating intermediate conveyor further includes a cam to swivel the conveying elements around the swiveling axis and wherein each of the conveying elements includes a roller to cooperate with the cam.

14. A conveying arrangement for printed products, comprising:

a feed conveyor to successively transport the printed products in a transporting direction to a takeover region;

a transporting device having a transfer region to receive the printed products; and a circulating intermediate conveyor to transport the printed products from the takeover region to the transfer region of the transporting device, the circulating intermediate conveyor including an endless track having a plurality of conveying elements to respectively grip the printed products and transport the gripped printed products from the takeover region to the transfer region where the printed products are transferred to the transporting device, the conveying elements having a swiveling axis that extends transverse to the transporting direction, wherein at least in an area between the takeover region and the transfer region, the conveying elements are mounted and arranged to swivel in a controlled movement around the swiveling axis, wherein the circulating intermediate conveyor comprises a wheel shape and the conveying elements are positioned with uniform spacing along a periphery of the intermediate conveyor.

15. A conveying arrangement for printed products, comprising:

a feed conveyor to successively transport the printed products in a transporting direction to a takeover region;

a transporting device having a transfer region to receive the printed products; and a circulating intermediate conveyor to transport the printed products from the takeover region to the transfer region of the transporting device, the circulating intermediate conveyor including an endless track having a plurality of conveying elements to respectively grip the printed products and transport the gripped printed products from the takeover region to the transfer region where the printed products are transferred to the transporting device, the conveying elements having a swiveling axis that extends transverse to the transporting direction, wherein at least in an area between the takeover region and the transfer region, the conveying elements are mounted and arranged to swivel in a controlled movement around the swiveling axis, wherein the conveying elements are swiveled in a controlled movement in the transfer region and the conveying elements include a mechanism to drive the printed products on each of the conveying elements to transfer the printed products to the transporting device.

16. A conveying arrangement for printed products comprising:

a feed conveyor to successively transport the printed products in a transporting direction to a takeover region;

a transporting device having a transfer region to receive the printed products, wherein the transporting device includes a plurality of containers into which the printed products are inserted; and a circulating intermediate conveyor to transport the printed products from the takeover region to the transfer region of the transporting device, the circulating intermediate conveyor including an endless track having a plurality of conveying elements to respectively grip the printed products and transport the gripped printed products from the takeover region to the transfer region where the printed products are transferred to the transporting device, the conveying elements having a swiveling axis that extends transverse to the transporting direction, wherein at least in an area between the takeover region and the transfer region, the conveying elements are mounted and arranged to swivel in a controlled movement around the swiveling axis.

17. A method to process individual printed products, comprising the steps of:

successively transporting the individual printed products with a feed conveyor in a transporting direction to a takeover region;

receiving the individual printed products at a transporting device having a transfer region; and transporting the individual printed products with a circulating intermediate conveyor from the takeover region to the transfer region of the transporting device, the circulating intermediate conveyor including an endless track having a plurality of conveying elements to respectively grip the individual printed products and transport the gripped individual printed products from the takeover region to the transfer region where the individual printed products are transferred to the transporting device, the conveying elements having a swiveling axis that extends transverse to the transporting direction, wherein at least in an area between the takeover region and the transfer region, the conveying elements are mounted and arranged to swivel in a controlled movement around the swiveling axis, and wherein the feed conveyor supplies the individual printed products approximately tangential to the circulating intermediate conveyor, at least in the takeover region.

18. A method to process stacks composed of different printed products, comprising the steps of:

successively transporting the different printed products with a feed conveyor in a transporting direction to a takeover region;

receiving the different printed products at a transporting device having a transfer region; and transporting the different printed products with a circulating intermediate conveyor from the takeover region to the transfer region of the transporting device, the circulating intermediate conveyor including an endless track having a plurality of conveying elements to respectively grip the different printed products and transport the gripped different printed products from the takeover region to the transfer region where the different printed products are transferred to the transporting device, the conveying elements having a swiveling axis that extends transverse to the transporting direction, wherein at least in an area between the takeover region and the transfer region, the conveying elements are mounted and arranged to swivel in a controlled movement around the swiveling axis, and wherein the feed conveyor supplies the different printed products approximately tangential to the circulating intermediate conveyor, at least in the takeover region.

* * * * *